United States Patent [19]

Görike

[11] 4,005,278

[45] Jan. 25, 1977

[54] HEADPHONE

[75] Inventor: Rudolf Görike, Vienna, Austria

[73] Assignee: AKG Akustische u. Kino-Gerate Gesellschaft m.b.H., Vienna, Austria

[22] Filed: Sept. 15, 1975

[21] Appl. No.: 613,578

[30] Foreign Application Priority Data

| | | |
|---|---|---|
| Sept. 16, 1974 | Austria | 7454/74 |
| Nov. 19, 1974 | Austria | 9261/74 |
| Nov. 29, 1974 | Austria | 9593/74 |
| Apr. 24, 1975 | Austria | 3170/75 |
| May 2, 1975 | Austria | 3380/75 |

[52] U.S. Cl. ..... 179/181 R; 179/180; 179/182 R

[51] Int. Cl.[2] ..... H04R 1/20

[58] Field of Search ..... 179/180, 181 R, 182 R, 179/156 R

[56] References Cited

UNITED STATES PATENTS

| | | | |
|---|---|---|---|
| 3,418,437 | 12/1968 | Hoffmann | 179/180 X |
| 3,798,392 | 3/1974 | Martin et al. | 179/180 X |
| 3,798,393 | 3/1974 | Gorike | 179/180 X |

*Primary Examiner*—William C. Cooper
*Attorney, Agent, or Firm*—McGlew and Tuttle

[57] ABSTRACT

The headphone preferably comprises a toroidal seal ring which rests against or surrounds the user's ear and is constituted of a soft, yielding, and preferably elastic material. The seal ring, with the headphone positioned on the head of a user, forms a coupling space between an active diaphragm, actuated by an electroacoustic transducer, and the auditory canal of the user's ear. This coupling space is substantially sealed from the exterior of the headphone, and is formed with at least one opening and preferably several openings each receiving a respective passive oscillatory diaphragm having a definite self-resonance. Each passive diaphragm is associated with a sound path leading therefrom to the open air, to the back side of the active transducer diaphragm, or to acoustically effective cavities. Respective acoustic frictional resistances are associated with each passive diaphragm. The arrangement of the passive diaphragms relative to the active transducer diaphragm may take various forms. The headphone principle is usable with so-called quadrophonic headphones, as well as under the chin headphones and headphones provided with artificial reverberation means such as coil springs.

44 Claims, 31 Drawing Figures

FIG. 19
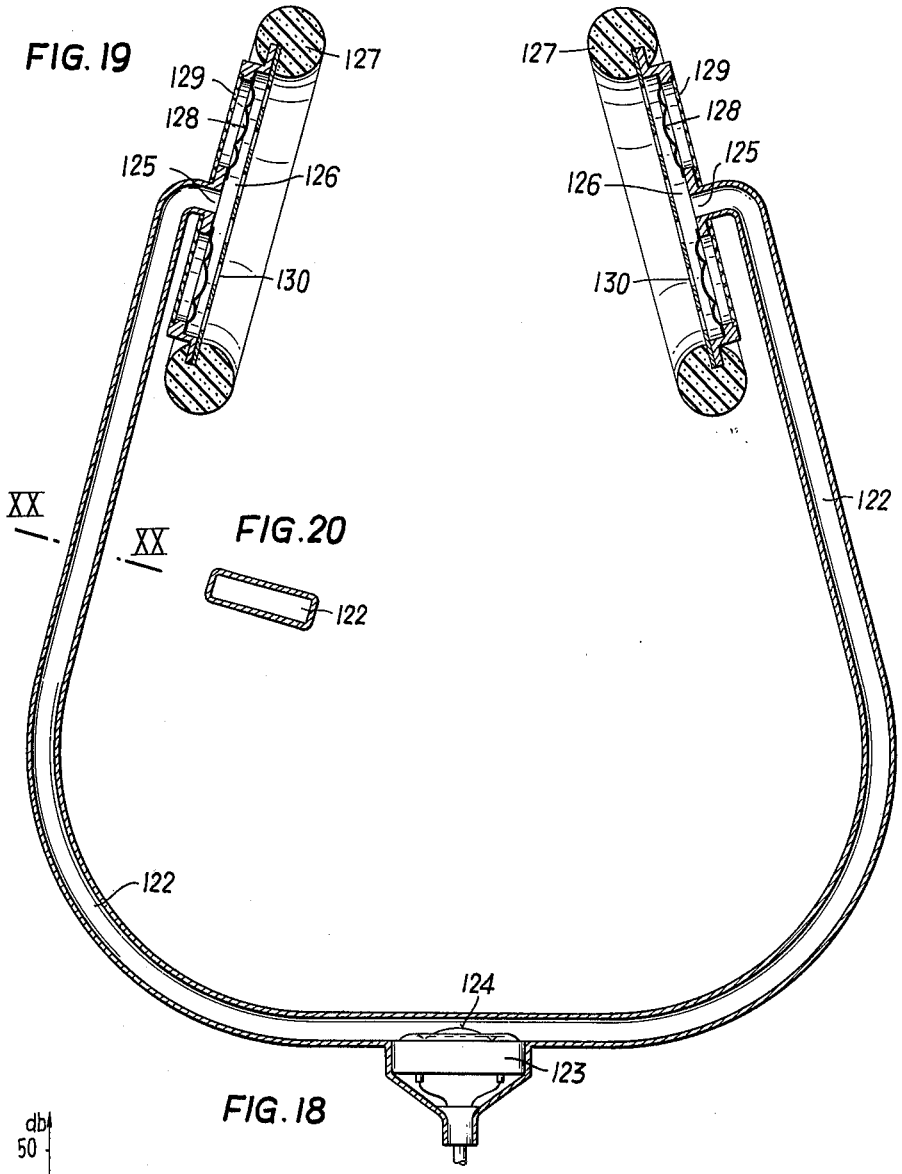
FIG. 20
FIG. 18
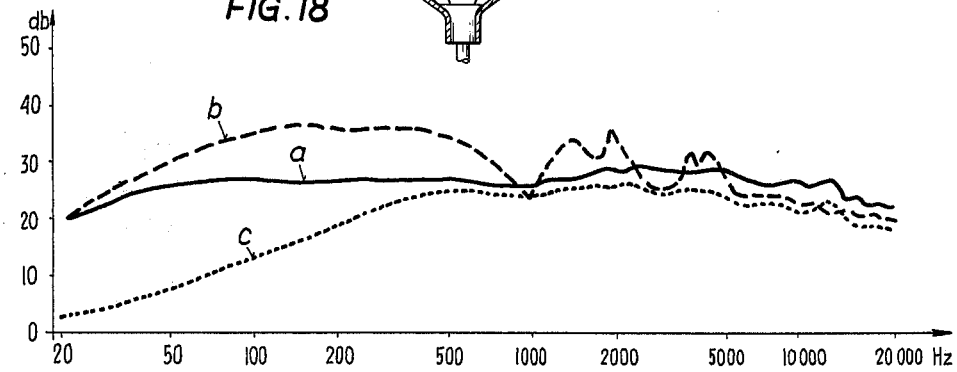

HEADPHONE

FIELD AND BACKGROUND OF THE INVENTION

The present invention relates to a headphone preferably comprising a toroidal seal ring which, in operational position, rests against or surrounds the user's ear and is made of a soft, yielding, preferably elastic material, and by which, with the headphone put on, a coupling space between the diaphragm, actuated by an electroacoustic transducer, and the auditory canal is formed and largely sealed off to the outside.

It is well known that the manner of coupling of the headphone or the transducer diaphragm comprised therein to the ear is of fundamental importance for the acoustic impression.

An impression closer to natural sound perception is obtained by providing that the headphone is not brought into tight contact with the ear but put on with the interposition of a foam material pad. A headphone of such a design is termed an "open headphone". The manner of coupling used in this case, however, has the disadvantage that, due to the sound path from the front to the backside of the transducer diaphragm acting as an acoustic short, the reproduction of the low frequencies is deficient. This results from the fact that the foam pad represents a frictional resistance having only a small acoustic mass, to which the acoustic frictional resistance provided for the damping of the diaphragm and, if provided, an acoustic mass coupled with the transducer diaphragm, are to be added. Thus, in a known headphone of this kind, only frictional resistances and acoustic masses are located in the sound path from the front to the back side of the transducer diaphragm and that is why its response, which is a function of the reciprocal ratio of the wave length to the length of the sound path around the transducer diaphragm, is dependent on frequency. This accounts for the decline at the low end of the frequency characteristic in the so-called open headphones.

In the other type of headphones in which an as close a coupling as possible between the transducer diaphragm and the ear is sought and the tight enclosure at the ear is realized by means of a soft ear cushion, not only the wellknown and unpleasant "in-the-head-localization" of the transmitted acoustic event occurs but, in addition, the frequency range from about 200 Hz to about 1500 Hz is over-accentuated.

SUMMARY OF THE INVENTION

The present invention is directed to a headphone in which the drawbacks of the prior art are largely avoided. In particular, the inventive headphone has a steady frequency response from the lowest to the highest frequencies and the acoustic means used in the invention make it possible to obtain the optimum frequency characteristic by a corresponding adjustment.

The invention also permits, by means of measures described in more detail hereinafter, to eliminate the "in-the-head-localization" during the perception of an acoustic event.

In accordance with the invention, in a headphone of the kind described above, i.e., comprising a coupling space between the transducer diaphragm and the ear closed to the outside, the coupling space is provided with one or more openings in which passive, oscillatory diaphragms having a definite self-resonance are received, and with which sound paths are associated leading to the open air, to the back side of the active transducer diaphragm, or to acoustically effective cavities.

By a passive diaphragm, is to be understood a diaphragm having a mass and a restoring force and capable of oscillation which, however, is not actuated by a transducer system, but merely is responsive to air oscillations.

In principle, the invention provides a restoring force placed in a sound path which, for example, may lead from the front to the back side of the transducer diaphragm, into the open air or into an acoustically effective cavity. In a most simple embodiment of the invention, the restoring force of a passive diaphragm is used. In the sound path where it is provided, the action of the passive diaphragm consists in that, in the range of its resonance frequency, the transmitting resistance of the diaphragm, by analogy with the electric series-resonant circuit, becomes a minimum so that the resistance of the sound path comprising the passive diaphragm also becomes negligibly small or, in other words, no appreciable resistance is opposed to the sound passage in the resonance range of the associated passive diaphragm, unless the passive diaphragm is provided with a damping resistance which then determines the resistance value in case of resonance.

For frequencies which are lower than the self-resonance of the passive diaphragm, the restoring force of this diaphragm blocks the sound path in which the diaphragm is mounted, while for the frequencies above the self-resonance of the passive diaphragm, the mass of the diaphragm is the cause of an increased resistance in the mentioned sound path.

By correspondingly defining the resonance frequency of the passive diaphragm in the sound path, for example, from the front to the back side of the active, i.e., transducer-actuated, diaphragm and with a corresponding damping, the frequency characteristic of the headphone can be influenced very effectively.

Even though it has been found that a substantial improvement of the frequency characteristic of a headphone can be obtained already if, in accordance with the invention, only one passive diaphragm, if necessary damped by a frictional resistance associated therewith, is provided in a sound path extending from the front to the back side of the active transducer diaphragm, a complete adjustment of the frequency characteristic of a headphone to a desired shape is obtainable, in most cases, only if a plurality of sound paths leading out of the coupling space and comprising the inventive passive diaphragm arrangement is provided. This may be a plurality of parallel sound paths extending from the front to the back side of the active transducer diaphragm and provided with passive diaphragms which have mutually different self-resonances and also may be unequally damped. Further, sound paths may be provided leading into the open air or into acoustic cavities and also equipped, in accordance with the invention, with passive diaphragms having mutually equal or unequal self-resonances and associated with corresponding acoustic frictional resistances. Since there is free scope for the choice of the self-resonance of each of the passive diaphragms and their damping can also be chosen correspondingly, the frequency characteristic of the headphone can not only be equalized, but also influenced in any manner, for example, by imparting to it a particular, desired and, in any case, non-standard shape.

If, as mentioned above, there is used a plurality of passive diaphragms which may have different self-resonances, it is advantageous, in accordance with the invention, to place the transducer diaphragm proper in the center of the headphone-side boundary of the coupling space and to locate the passive diaphragms therearound.

If, on the other hand, a single passive diaphragm is used, it is advantageous to place the transducer diaphragm again in the center of the headphone-side boundary of the coupling space but to design the passive diaphragm as a substantially flat ring surrounding the active diaphragm. To obtain desired properties, for example, an increased stiffness or the formation of partial resonances, the surface of the annular, passive diaphragm may be correspondingly embossed.

A further effect of the inventive provision is to be seen in that due to the insertion of at least one passive diaphragm into at least one sound path extending from the front to the back side of the active diaphragm, in the range of the high frequencies of between 5000 Hz and 16,000 Hz where, in general, the headphones show a more or less distinct drop of the frequency characteristic, the frequency characteristic can be raised.

It has also been found that the inventive arrangement of passive diaphragms in sound paths extending from the coupling space can advantageously be used also in headphones for quadrophonic reception in which two sound sources are mounted in each earpiece. That is, the headphones for the four-channel reproduction (quadrophony) known up to date have the disadvantage that the diaphragms of the transducers mounted in each earpiece necessarily have a common coupling chamber to the ear and influence each other unfavorably in a manner such that the frequency range of approximately between 200 Hz and 1500 Hz is overemphasized and resonances are produced in the coupling chamber since this chamber is large relative to the wave lengths.

Even though the invention is primarily directed to the improvement of the frequency characteristic of stero headphones, experience has shown that it produces an additional, surprising effect in headphones for quadrophony also, thus, in headphones in which two electroacoustic transducers are provided for each ear, in a single earpiece. This effect consists in that, in the frequency range of approximately three octaves determined by the resonance and damping of the passive diaphragms, the stiffness of the coupling chamber is reduced and an acoustic short circuit is established from the front to the back side of the active transducer diaphragm whereby an occurrence of undesirable resonances is prevented. The improvement of the frequency characteristic, as described hereinabove is, of course, maintained also.

Therefore, in headphones which, for a quadrophonic reproduction of acoustic events, are equipped with two electroacoustic transducers for each ear, it is provided, in accordance with the invention, to associate each active transducer diaphragm mounted in the boundary of the coupling space with one or more passive diaphragms.

In a particularly satisfactory design, in accordance with the invention, one or more of the passive diaphragms are provided in the boundary of the coupling space, between the two active diaphragms. However, from the point of view of construction and manufacture, it is still more advantageous to locate the active diaphragm within the passive diaphragm having an annular or other closed shape so that the active diaphragm is surrounded on all sides by the passive diaphragm with, if desired, the internal rim of the passive diaphragm and the external rim of the active diaphragm spaced from each other.

Such a spaced relationship, however, which may be advantageous for constructional reasons, is not substantial for the functioning of the arrangement and that is why, in accordance with the invention, a direct connection of the two mentioned diaphragm rims is also provided. As far as one and the same material is used for the two diaphragms, thus both for the active diaphragm and for the passive diaphragm, the two diaphragms can be manufactured in one operation, from one piece. During the assemblage, however, care must be taken that, in assembled state, the zone where the passive diaphragm blends with the active diaphragm be incapable of oscillating, at least substantially. This is obtained by firmly connecting the just-mentioned zone, representing the junction area between the active diaphragm and the passive diaphragm, in assembled state of the diaphragm unit formed by cementation or made in one piece, through a projection, for example, in the form of a web, an insert, a toroidal body, or the like, to the boundary surface of the coupling space carrying the diaphragms. If necessary, the insert or toroidal body can be made of a material which is elastic or hard, absorbing, or acoustically stiff.

In a development of the invention, it has been taken into account that the invention is advantageously applicable also to such constructions of headphones in which the earpiece resting against or surrounding the ear is spaced from the electroacoustic transducer by a larger distance and the earpiece communicates with the transducer through an acoustic conduit.

Such constructions are known under the designation of "stethoscope headphones" or "underchin headphones". In the simplest case, for monaural listening, such headphones need only a single transducer wherefrom resilient or flexible acoustic conduits in the form of tubes lead to earpieces or ear knobs.

However, the invention is not limited to such constructions. It also can be applied to cases where acoustic delay lines are provided between the transducer and the ear.

Further, in general, there is a dislike of using such acoustic lines in the sound transmission between ear and transducer because the so-called pipe resonances may occur markedly deteriorating the sound impression. For example, with a line having a length of 23 cm, resonance phenomena occur at 370, 1110 and 1850 Hz.

If, in accordance with the invention, passive diaphragms are provided in the coupling space which are tuned to these frequencies and correspondingly attenuated by an associated frictional resistance, such pipe resonances can largely be suppressed so that a completely satisfactory frequency characteristic is obtained for the entire arrangement.

In a headphone in which an acoustic line in the form of a tube is provided between the transducer and the earpiece, the coupling space, in principle, is divided into two compartments which are connected to each other through the acoustic line. One compartment comprises the cavity in front of the active transducer diaphragm wherefrom the acoustic line originates and the second compartment is located at the end of the line and is encompassed by the earpiece and the soft or elastic toroidal body which, in service, seals the ear toward the outside.

In a further development of the invention, the passive diaphragms, if desired damped by a frictional resistance, are mounted in the compartment of the coupling space which, in operational position, accommodates the ear, and perhaps also in the compartment of the coupling space adjacent the active diaphragm, in both cases, in the sound path extending from these compartments.

According to a further feature of the invention, it may be useful to provide the self-resonances of the passive diaphragms in the same or identical frequency range, since, due to this measure, particularly strong pipe resonances are successfully compensated or a band filter-like effect is obtained if, for example, through influence from the outside or due to particularities of the construction, the one or the other of the pipe resonances is subjected to variations. A band filter-like effect is also useful in cases where manufacturing tolerances are of importance because then a subsequent tuning of the passive diaphragm becomes superfluous, as long as the resonance frequency is situated within the provided band width of the damping range of the passive diaphragm.

Should a plurality of disturbing resonance phenomena occur, it may be provided, in accordance with the invention, to tune the passive diaphragms, correspondingly damped by associated frictional resistances, as the case may be, individually or in groups to the disturbing resonances and/or irregularities in the frequency characteristic.

The invention makes it possible to influence the sound pressure in the coupling space in definite frequency ranges, for example, of about 500 Hz, within an effective range of approximately four octaves and, thereby, to prevent the resonance phenomena in the coupling space, in particular by providing an approriate acoustic damping of each of the used passive diaphragms by means of an acoustic frictional resistance associated therewith.

Substantially, it is sufficient to provide a suitable sound path equipped, in accordance with the invention, with a passive diaphragm which may cooperate with a frictional resistance, and leading from the coupling space to the open air.

This is why, in practice, the invention is embodied so that the opening or at least one of the openings of the coupling space, provided with a passive diaphragm, preferably cooperating with a frictional resistance, leads into a cavity which, in its turn, is provided with an opening leading to the open air and having a negligible acoustic resistance, while the back side of the active diaphragm preferably communicates with an acoustic cavity which is either provided with an opening to the outside having a high acoustic frictional resistance or completely closed to the outside.

The same effect, however, can be obtained with an arrangement in which, for example, a sound path comprising a passive diaphragm and, perhaps, a frictional resistance associated therewith, extends from the coupling space to a sufficiently large acoustic cavity and the back side of the active transducer diaphragm preferably communicates also with an acoustic cavity which is either completely closed or communicates with the outside only through a high acoustic frictional resistance.

The inventive provision of mounting damped passive diaphragms in the sound path to influence the frequency characteristic of a headphone makes it possible to use simple mechanisms for the variation of the frictional resistances associated with the passive diaphragms which results in a frequency characteristic adjustment controllable from the outside of the headphone.

One of these simple mechanisms comprises an apertured disc which is associated with the frictional resistance for damping the passive diaphragms, turnable from the outside, and provided with apertures in a number and shape corresponding to the passive diaphragms and with which the effective surface of the frictional resistance can be adjusted to any value, from zero to the maximum.

Another construction could be designed so that a variable pressure acts from the outside on the material of the frictional resistance or resistances, thereby varying its density and, consequently, also its acoustic resistance.

It is a further advantage of the invention that, because of the small space needed for the passive diaphragms in the coupling space, sufficient space remains available for a second transducer, preferably an electrostatic transducer closed at its back side, for example, an electret transducer, which is particularly suitable for the reproduction of high-pitched sounds.

It is not absolutely necessary to mount the passive diaphragms provided in the sound paths, in accordance with the invention, at the boundary of the coupling space. For space-saving reasons, it is also possible, particularly in a headphone having cavities which can be coupled to the outside air, to mount the passive diaphragms in the openings of such cavities leading to the outside.

According to a very advantageous provision in accordance with the present invention, instead of a plurality of individual passive diaphragms, a single diaphragm is used having preferably the form of a short, cylindrical tube and substantially mounted in the zone of the shell of the headphone casing.

According to a further development of the invention, there is provided a headphone evoking an acoustic impression which is very close to a fidelity reproduction of natural sounds. In particular, such a design eliminates the known effect of the "in-the-head-perception" and produces and acoustic impression coming near the spatial sound which, analogously to the spatial sound, also includes reverberation effects and, in addition, is capable of converting frequency modulated sound oscillations of musical instruments having a small frequency variation into amplitude modulated sound oscillations, as is also the case with a loudspeaker acoustic radiation due to the irregular frequency characteristic of loudspeakers and the reflections produced in the room.

This problem is solved, for a headphone of the kind described above, by providing that one or more of the passive diaphragms are connected to at least one oscillatory structure comprising a plurality of closely adjacent resonance points, and/or are designed themselves as such a structure.

According to another feature of the invention, the oscillatory structure connected to one or more of the passive diaphragms is a helical spring, preferably having a surface comprising, in the macroscopic and microscopic range, statistically distributed irregularities.

Another feature of the invention is to be seen in that at least a part of the passive diaphragms have their mass or elasticity unevenly distributed, which makes them an oscillatory structure also having numerous, closely adjacent, resonance points, at least within a larger frequency range. In practice, such a mass or elasticity distribution can very easily be obtained already in the manufacture of the passive diaphragm, for example, by embossing regular or irregular configurations and/or by providing regular or irregular accumulations of the diaphragm material. Yet, the mass or elasticity distribution may also be influenced by applying another material, for example, metal or plastic particles of any shape and size. The selection of the material and its form depends on which properties the manufacturer intends to impart to, or the designer considers useful for, the headphone.

Particularly advantageous are embodiments of the invention in which the passive diaphragms are arranged concentrically of the (centrally located) diaphragm of the electroacoustic transducer, it being preferable to provide an even number of passive diaphragms.

The even number has the advantage that, if a connection of helical springs with the passive diaphragms is intended, regular polygons can be formed of the helical springs coupling the passive diaphragms also in cases where, for example, only every other passive diaphragm is to be coupled to the system comprising a plurality of helical springs. Regular polygons are desirable because they surround an inscribed circle which is concentric with the circular boundary line of the transducer diaphragm and, therefore, do not obstruct the access to the transducer or its diaphragm. In addition, in this arrangement, the springs can be covered by an annular part of the earpiece so that they are inaccessible from the outside and cannot be damaged.

The invention permits of numerous variants. For example, it is possible to vary the number of the passive diaphragms of which some or all comprise closely adjacent resonance points. Further, combinations with helical springs may be provided, in which case also helical springs having different physical properties are to be considered. Moreover, by means of helical springs, homogeneous passive diaphragms may be coupled to diaphragms having unevenly distributed masses and elasticities, etc.

An object of the invention is to provide an improved headphone having a steady frequency response.

Another object of the invention is to provide an improved headphone having an optimum frequency characteristic.

A further object of the invention is to provide an improved headphone in which "in-the-head-localization" is eliminated.

For an understanding of the principles of the invention, reference is made to the following description of typical embodiments thereof as illustrated in the accompanying drawings.

BRIEF DESCRIPTION OF THE DRAWINGS

In the Drawings:

FIG. 18 graphically shows the respective frequency characteristics for comparison;

FIG. 19 is a diagrammatical sectional view of an underchin headphone equipped with the inventive means;

FIG. 20 is a detail of FIG. 19;

DESCRIPTION OF THE PREFERRED EMBODIMENTS

Figure 1:
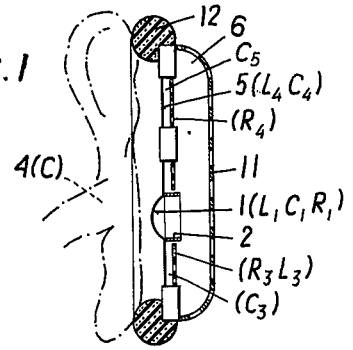
FIG. 1 is a diagrammatic sectional view of a simple embodiment of the invention, showing only one sound path from the front to the back side of the active diaphragm, through a passive diaphragm and a frictional resistance associated therewith.

In the embodiment of FIG. 1 which is intentionally simple and shown but diagrammatical for better understanding, only one sound path is provided from the front side of the active transducer diaphragm to the back side of the same, which sound path, in accordance with the invention, is provided with a passive diaphragm having a definite selfresonance and with an acoustic frictional resistance associated therewith.

As had already been mentioned in the beginning, the idea underlying the invention is to replace the simple series connection of frictional resistances and masses, which is usual in the known headphones, by a series-resonant circuit so that, due to an appropriate dimensioning of the elements of this circuit, a selective shunt to the remaining acoustic impedance of the headphone becomes effective corresponding to the necessities of correcting the frequency characteristic of the headphone. In other words, the sound path, for example, from the front to the back side of the active diaphragm, has to comprise an element which, in the equivalent circuit diagram, corresponds to a seriesresonant circuit. In acoustics, such an element is represented by a passive diaphragm having both a restoring force (capacitance) and a mass (inductance) as well as a frictional resistance (ohmic resistance in the equivalent circuit diagram). In most cases, the frictional resistance will have a negligibly small value in view of the fact that it is small relative to other acoustic frictional resistances present in the sound path.

The arrangement in principle of such a passive diaphragm may be learned from the diagrammatical view of FIG. 1. As in the known headphones, the headphone in accordance with the invention also comprises an electroacoustic transducer of which, however, only its (active) diaphragm 1, as shown in FIG. 1. With the headphone contacting the ear, diaphragm 1 operates into a coupling space 4 which, substantially, is formed by the cavity between the ear and the headphone. In the equivalent circuit diagram, the restoring force of the coupling space is symbolized by the capacitance C.

A passive diaphragm 5 corresponding to a seriesresonant circuit is inserted in an opening provided in the headphoneside boundary of coupling space 4. The back side of diaphragm 5 communicates acoustically with the backside of the active transducer diaphragm. In the equivalent circuit diagram of FIG. 2, passive diaphragm 5 furnishes the restoring force $C_4$, the mass $L_4$ and the frictional resistance $R_4$. Since, in general, the frictional resistance is very small so that, in most cases, additional resistances are necessary, this resistance $R_4$ is entered in FIG. 1 separately, closely adjacent the passive diaphragm 5.

Figure 3:
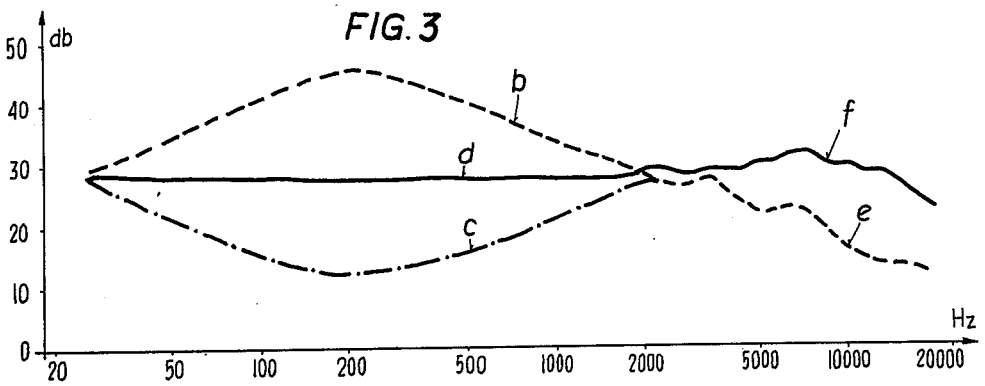
FIG. 3 graphically shows different frequency characteristics illustrating the function.

In conformity with the invention, the restoring force $C_4$ of diaphragm 5 is the most important acoustic element. It prevents an acoustic short circuit in the low-frequency range and increases the sound pressure in coupling chamber 4 in the high-freuqncy range. The resonance of passive diaphragm 5, depending on $L_4$ and $C_4$, is provided so that, with a closed headphone, i.e., a headphone which, substantially, is tightly applied to the ear, the curve *b* plotted in FIG. 3 and distinctly cambered or curved in the range between 200 Hz and 1500 Hz is transformed into a horizontal line *d*. This transformation is due to the short-circuiting effect of the passive diaphragm 5 approximately following the line c. In addition, aside from further effects, the resonance of mass $L_4$ of the passive diaphragm related to the restoring force C of coupling space 4 causes a sonic pressure increase in coupling space 4. In FIG. 3, this is illustrated by the curve *f* as compared to curve *e*.

Due to the relatively high restoring force C of chamber 4, passive diaphragm 5 is coupled to the active diaphragm 1 so that, within the range where the frequency characteristic is to be flattened, for example, between 200 Hz and 1500 Hz, the two diaphragms oscillate in phase. Advantageously, the frictional resistance $R_4$ is dimensioned so that the decrement symmetrically corresponds to the chamber. As usual in headphones, a case or housing 6 is provided which may be sound-transmitting or closed. The just described physical phenomena distinguish the operating characteristics of the inventive arrangement substantially from the effect of the well-known passive diaphragm in a loudspeaker housing where the motion of the passive diaphragm, due to its mass and the restoring force of the volume of the housing, is in phase quadrature relative to the active diaphragm. The composition of the components diverging by 90° results in an increased efficiency of the loudspeaker. In the headphone in accordance with the invention, no increase of efficiency occurs in the range between 200 Hz and 1500 Hz.

Figure 2:
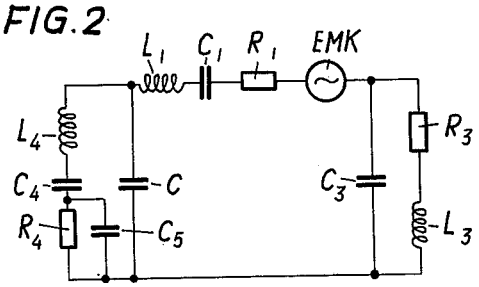
FIG. 2 shows the respective equivalent circuit diagram.

In the high frequency range, the efficiency is distinctly increased by the inventive arrangement. Reference is made to FIG. 2 for an explanation of the physical relations. Two resonance circuits are present. The one comprises the mass $L_4$ of diaphragm 5 and the restoring force C of coupling space 4 and is damped by the frictional resistance $R_4$ and the internal friction of the auditory canal. The second resonance circuit comprises the diaphragm mass $L_4$ and the restoring force $C_5$ in the very small cavity between diaphragm 5 and frictional resistance $R_4$. This increases the air velocity. In addition, in the frequency range where half the wave length is equal to the sound detour, the sound pressure in the coupling space is increased. The three mentioned effects can be dimensioned so that they combine to result in a steady characteristic in the high-frequency range. This phenomenon is a further, unexpected, effect of the invention.

Figure 4:
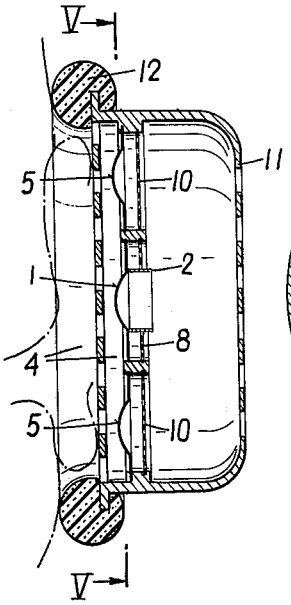
FIG. 4 is a sectional view of an embodiment comprising a plurality of passive diaphragms located around the active transducer diaphragm.
Figure 5:
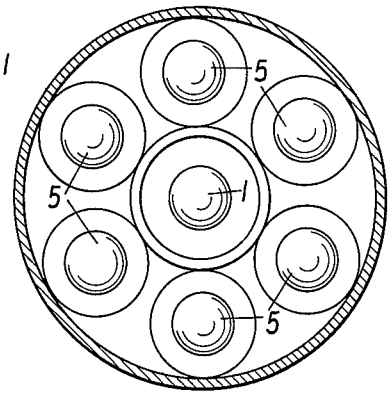
FIG. 5 is a sectional view taken along the line V—V of FIG. 4.

As far as it is not possible to sufficiently straighten the frequency characteristic of the headphone with a single passive diaphragm, a plurality of passive diaphragms may also be provided, in accordance with the invention, in the sound path leading from the front to the back side of the active diaphragm. Such an embodiment is represented in FIG. 4 in a sectional view while FIG. 5 is an elevation view of the diaphragm plane in which the headphone-side boundary of coupling space 4 is situated. In this embodiment, active diaphragm 1 is located in the center and is surrounded, for example, by six passive diaphragms 5 which are associated with respective frictional resistances 10. Active diaphragm 1 is also damped by means of a frictional resistance 8.

Figure 6:
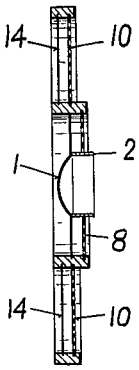
FIGS. 6 and 7 are, respectively, a diagrammatical sectional view and an elevation view of an embodiment comprising a passive diaphragm annularly surrounding the active diaphragm.
Figure 7:
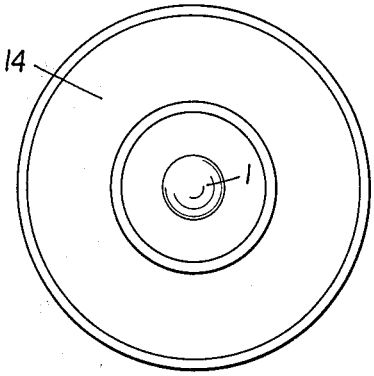

FIGS. 6 and 7 show an embodiment of the invention in which active diaphragm 1 is again located in the center, but is surrounded by a single, annular, substantially plane passive diaphragm 14.

As in all of the other embodiments, and in this embodiment as well, damping elements in the form of frictional resistances 8, 10 are provided which can be appropriately adjusted so as to influence the frequency characteristic of the headphone. Of course, in addition, the self-resonance of each of the passive diaphragms provided is an equally determining factor for the degree of correction and, thereby, the desired linear shape of the frequency characteristic.

Figure 8:
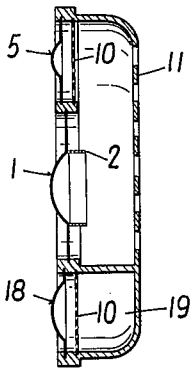
FIGS. 8 and 9 are diagrammatical sectional views of embodiments in which, in addition to a sound path from the front to the back side of the active transducer diaphragm, a sound path is provided comprising a passive diaphragm and leading from the coupling space into a closed acoustic cavity.

FIG. 8 is a diagrammatical view of an embodiment in which, aside from the active diaphragm 1 and the passive diaphragm 5 provided in the sound path extending from the front to the back side of active diaphragm 1, another passive diaphragm 18 is mounted in the sound path leading to an acoustic compartment 19 whereby, in practice, the coupling of cavities to coupling space 4 can be influenced in any manner.

If a plurality of passive diaphragms is used, they may have mutually equal or different resonant ranges. With the provision of a single, annular, passive diaphragm, it may be useful to provide it with embossed areas of any shape, either for reinforcement or for obtaining partial resonances.

Since the invention concerns a closed headphone which must be tightly applied to the ear or to the head while surrounding the ear, an annular toroidal sealing body 12 made of a soft, yielding or elastic material is provided in all of the embodiments.

A case cap 11 with or without perforations for ventilation may close the headphone toward the outside so that its interior is protected against dust and contamination. At the same time, the headband may be secured to cap 11.

Figure 9:
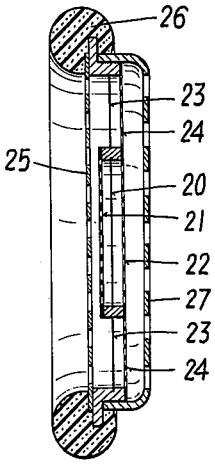

The invention is not limited to electrodynamic transducers buty may be applied to electroacoustic transducers of any kind. FIG. 9 is a diagrammatical illustration of an embodiment comprising an electrostatic transducer in which an active diaphragm 20 is mounted between two perforated electrodes 21, 22. A passive diaphragm arrangement 23 with a damping resistance 24 is provided round about the transducer. A protective plate 25 having numerous perforations and an ear pad 26 limit the space adjacent the ear. A perforated case 27 serves as a cover. A headphone thus designed also has a very small weight.

Figure 10:
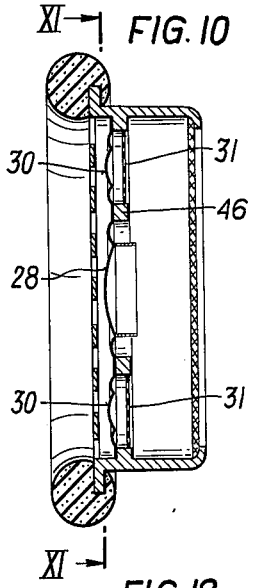
FIGS. 10 through 15 are, respectively, diagrammatical sectional and elevation views showing the application of the invention to headphones for quadrophonic reception.
Figure 11:
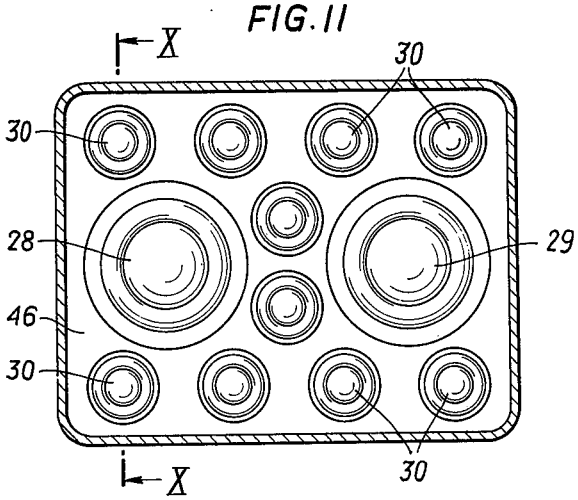

FIGS. 10 to 15 relate to embodiments of headphones for quadrophonic reception. FIG. 10 is a sectional view taken along the line X—X of the top view of FIG. 11 and, basically, shows the same arrangement provided in the embodiments described hereinbefore. There is a difference, however, that, due to the intended use of the headphone for quadrophonic reception, two active diaphragms 28, 29 are provided as may be seen in the partly sectioned elevation view of FIG. 11. In accordance with the invention, passive diaphragms 30 are mounted between and partly also around these transducer diaphragms 28 and 29 and which, as already mentioned above, are effective in damping the coupling space in the frequency range important for the localization of sound sources, while the precise bass response is ensured in the same manner as in a closed headphone.

All of the diaphragms, the passive diaphragms as well as the active diaphragms, cover openings which are provided in the boundary surface 46 of the coupling space. Advantageously, the passive diaphragms 30 are damped by closely adjacent frictional resistances 31 enabling them to be effective in a larger frequency band. The frictional resistances may be located in front of or behind the passive diaphragm, but it is also possible to produce the necessary damping of the passive diaphragms by choosing an appropriate material, for example, paper or the like. If necessary, of course, even such a diaphragm may be influenced in its damping properties in addition by another frictional resistance located close thereto or by another appropriate acoustic measure.

Figure 12:
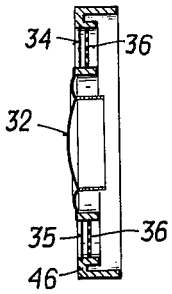
Figure 13:
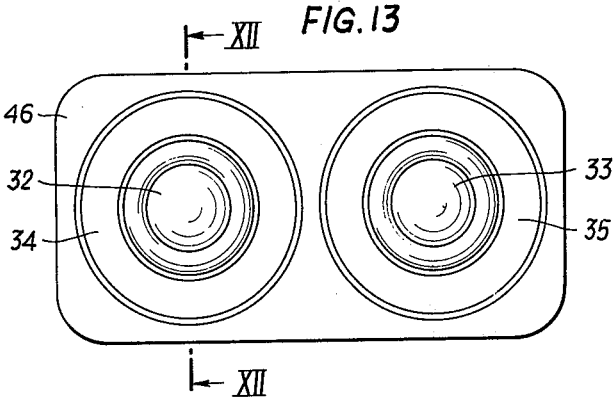

In the embodiments shown in FIGS. 12 and 13, the two active transducer diaphragms of the quadrophonic headphone are designated 32 and 33. They are surrounded by two annular, substantially plane, passive diaphragms 34 and 35 which are appropriately damped by frictional resistances 36.

The fundamental resonances of the passive diaphragms 34, 35 which may be indentical or different, the damping of the diaphragms, as well as the ratio of the surfaces of the passive diaphragms to the surface of the active diaphragms are the parameters to be suitably chosen in order to obtain the desired effect, namely, the sensation of being able to locate the sound source. To be sure, this does not apply only to the embodiments shown in FIGS. 12 and 13 but to all of the embodiments.

Figure 14:
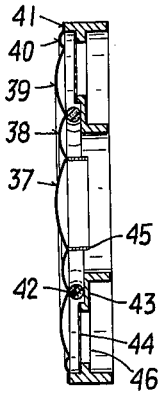
Figure 15:
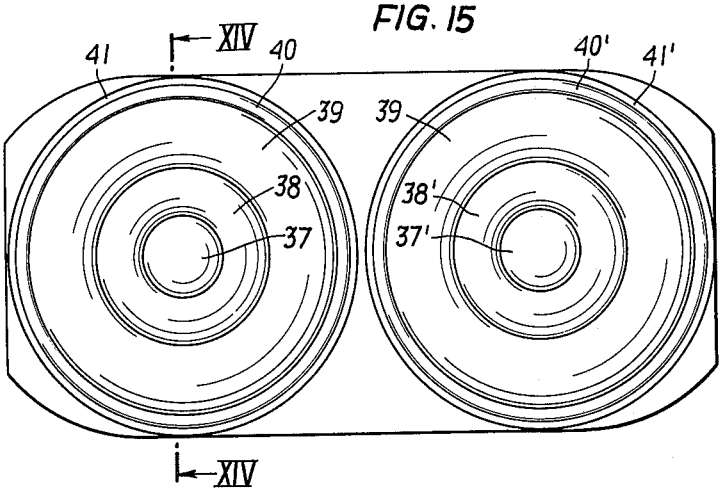

FIGS. 14 and 15 illustrate another embodiment of the invention. Here, one diaphragm as an integral component part is used which either is assembled of two different materials, for example, paper for the passive portion 39 and plastic foil for the active portion 37, or is completely made of one and the same material, preferably a plastic foil.

In the embodiment of FIGS. 14 and 15, it is assumed that the diaphragm is made in one piece of one material. That is, in the drawing, the difference relative to a diaphragm made of or assembled of different materials and having an active and a passive portion could hardly be shown. In principle, however, it is irrelevant which kind of diaphragm is provided. The following explanation applies to both possibilities. Thus, FIG. 14 shows a single diaphragm comprising a central cup 37, an annular, vaulted zone 38, and an also vaulted adjoining zone 39 which is provided with one or more marginal creases 40. A narrow, annular, plane zone 41 at the rim of the diaphragm serves for securing the same.

Between zones 38 and 39, the diaphragm is supported by an annular projection (toroidal body) 42 which may be elastic, or hard or absorbing, or acoustically stiff. The projection (toroidal body) is secured to a bracket 43 which is connected to the acoustic transducer or provided on the boundary surface 46.

For damping passive portion 39 of the diaphragm, an acoustic frictional resistance 44 is provided. The moving coil 45 is secured to the circumference of central cup 37 and telescopes into the air gap of a magnet system (not shown).

As long as projection (toroidal body) 42 is elastic and absorbing, the diaphragm may simply rest against it or be fixed thereto by means of an adhesive. This determines the active portion of the diaphragm extending within the annular projection (toroidal body) 42 and the passive portion of the diaphragm extending outside the projection (toroidal body) 42. The active portion of the diaphragm, comprising central cup 37 and yielding annular zone 38 and driven by moving coil 45, forms the sound emitter, while the passive portion of the diaphragm, comprising vaulted annular zone 39 and crease 40, ensures that the coupling space to the ear is not closed in an acoustically stiff manner but is adapted to be acoustically short-circuited, in the resonance range of the annular diaphragm portion 39 damped by frictional resistance 44, from the front side of active diaphragm portion 37, 38 to the back side thereof.

It is obvious for anyone skilled in the art that, as to the arrangement and design of the diaphragm, the second transducer system is identical with the first (left) one. To express this fact, identical reference numerals are used in FIG. 15, only with primes. The transducer systems, however, may also differ from each other which is in accordance with the principle of quadrophonic reproduction insofar as the transducers furnishing the room reverberation may have other acoustic properties.

Figure 16:
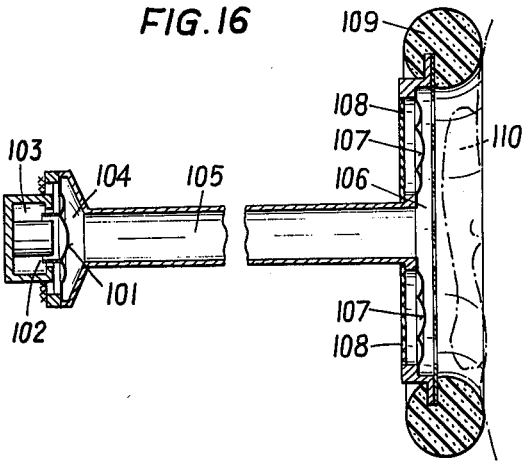
FIGS. 16 and 17 are, respectively, a sectional view and an elevation view of a headphone in which the coupling space is divided in two compartments communicating with each other through an acoustic line.

In the headphone respresented in FIG. 16, an electrosynamic transducer system is provided comprising a moving coil 102 movable in an annular air gap of a magnet system 103 and an active diaphragm 101 firmly connected thereto. In front of diaphragm 101, an air chamber 104 is provided communicating with an acoustic duct 105 which opens into an air chamber 106.

Figure 17:
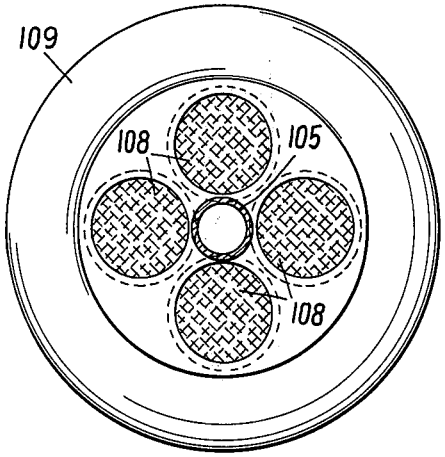

This chamber is provided, in a well-known manner, with an annular, soft and/or elastic, toroidal body 109 adapted to tightly surround the ear 110. In the solid boundary wall of this chamber 106, for example, four passive diaphragms 107 are provided connecting to the outside and associated with respective frictional resistances 108. The location of diaphragms 107 or frictional resistances 108 may be learned, for example, from FIG. 17. The passive individual diaphragms may also be replaced by a single, annular passive diaphragm surrounding the inlet of acoustic duct 105, in which case the corresponding frictional resistance will advantageously take a similar shape.

As a matter of course, coupling chamber 104 in front of active diaphragm 101 may also be equipped with passive diaphragms or a single such diaphragm, depending on the requirements imposed on the quality of the frequency response of the headphone and on economic considerations with respect to the justified expenses.

The coupling of the active transducer diaphragm 101 to the acoustic duct leading to the coupling chamber at the ear can be effected with or without velocity transformation.

It has been found that the invention can be applied with full effect both to a design with velocity transformation and to a design without such transformation. In both cases, the result is the same, as may be learned, for example, from the curves shown in FIG. 18.

While using a passive diaphragm in accordance with the invention, curve *a* is obtained showing a completely smooth shape. Upon substituting an acoustically stiff closure for the passive diaphragms, curve *b* is obtained showing a camber in the frequency range between 100 Hz and 500 Hz and a very uneven shape with a plurality of peaks and troughs in the higher frequency range. The linearizing effect of the inventive measure in headphones of any kind is evident.

An example of application in practice is shown in FIG. 19 depicting a complete underchin headphone for monaural reproduction, comprising a single sound transducer for both ears.

The single electroacoustic transducer 123 including an active diaphragm 124 feeds symmetrically a hollow fork 122 acting as an acoustic duct and having a cross-section which is shown, for example, in FIG. 20. At each outer end of fork 122, a coupling chamber 126 is provided which tightly applies, by means of ear pads 127, against the user's head. In the boundary wall of coupling chamber 128, a plurality of passive diaphragms 128 are mounted, in accordance with the invention, in sound paths leading into the open air or into otherwise effective acoustic cavities which may be open or closed. The sound passes from acoustic duct 122 through an opening 125 into coupling chamber 126.

A guard grid 130 prevents damaging of passive diaphragms 128 as well as of frictional resistances 129 associated therewith. The acoustic duct is made of a material having a satisfactory elasticity and giving the fork 122 properties of a resilient band.

Instead of the annular toroidal body closing the coupling space to the outside, an annular toroidal body closing the coupling space to the outside, an annular hollow body may also be used surrounding the ear and/or suspended from the ear and, advantageously, made of rubber or plastic having a small Shore hardness.

Figure 21:
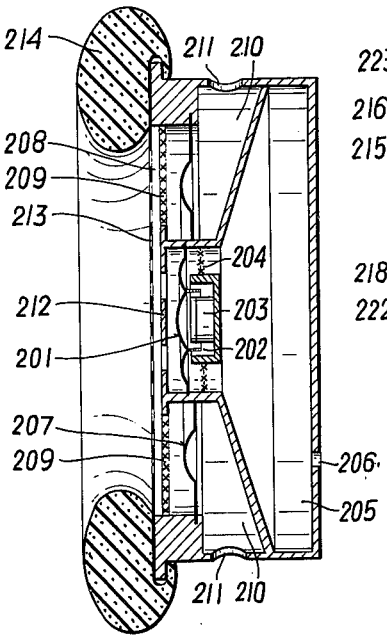
FIG. 21 through 24 are diagrammatical sectional views of further embodiments of the inventive headphone.

Further embodiments of the invention are illustrated in FIGS. 21 through 29. FIG. 21 shows an active transducer diaphragm 201 and a moving coil 202 secured thereto and telescoping into the air gap of a permanent-magnet system 203. An acoustic frictional resistance 204 damps diaphragm 201. Adjacent the back side of the transducer is a cavity 205 so that the sound waves coming from the back side of the transducer diaphragm pass through frictional resistance 204 into cavity 205. In the boundary wall of cavity 205, a sound passage 206 may be provided through which, because of the size of cavity 205 and the small cross-sectional area of passage 206, only low frequencies below approximately 150 Hz are transmitted. In this frequency range, the restoring force of passive diaphragms 207 prevent the sound transmission so that the full sound pressure is produced in coupling space 208. Acoustic frictional resistances 209 are provided in front of passive diaphragms 207. The back sides of passive diaphragms 207 communicate, through a cavity 210 and sound outlets 211, with the outside air.

In this arrangement, the front side of the transducer diaphragm is not acoustically short-circuited to the back side of the same. The short circuit is prevented, in the low frequency range below about 150 Hz, by the passive diaphragms and, in the medium frequency range around approximately 500 Hz, by the low pass filter formed by the acoustic mass in sound passage 206 and the restoring force of cavity 205. In front of a cap 212 forming a high-frequency resonance chamber and the frictional resistances 209, a protective grid or sheet 213 is provided. An ear pad 214 assures a sufficiently tight fit on the ear.

Figure 22:
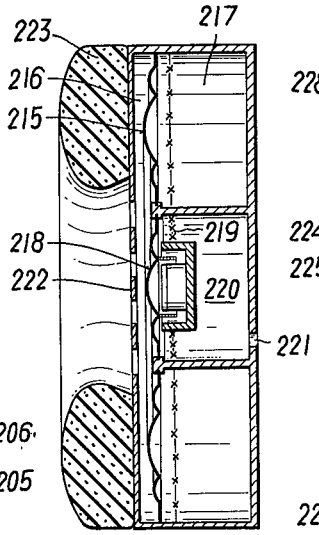

FIG. 22 shows another embodiment of the invention. The passive diaphragms 215 communicate, on the one side, with a coupling space 216 and, on the other side, with a cavity 217 which is closed to the outside. The back side of transducer diaphragm 218 is connected, through an acoustic frictional resistance 219, to a cavity 220 which may be provided with sound passages 221. Since cavity 217 is closed and cavity 220 is also closed or provided only with a mass-loaded sound passage 221 forming a low-pass filter, this embodiment does not transmit sound to the outside, nor can sound penetrate from the outside to the ear. In some cases, this can be of advantage. The action of the passive diaphragms linearizing the frequency characteristic remains fully effective, and the damping of coupling space 216 is also ensured, and without sound pressure losses at low frequencies. In this embodiment again, no acoustic short-circuiting of the transducer diaphragms takes place. A perforated protective sheet 222 and a flat ear pad 223 complete the construction and permit a tight contact with the ear.

Figure 23:
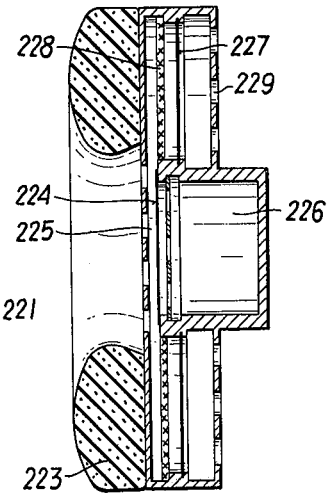

FIG. 23 shows an example of a headphone comprising an electrostatic transducer, for example, on electret basis. The electrostatic or piezoelectric transducer 224 operates, on the one hand, into a coupling space 225 and, on the other hand, into a cavity 226. Round about the transducer, an annular passive diaphragm 227 and a damping acoustic frictional resistance 228 are provided. The back side of passive diaphragm 227 communicates, through a sound transmitting protective grid 229, with the outside air. In this example, no acoustic short-circuiting can occur between the two sides of the diaphragm.

Figure 24:
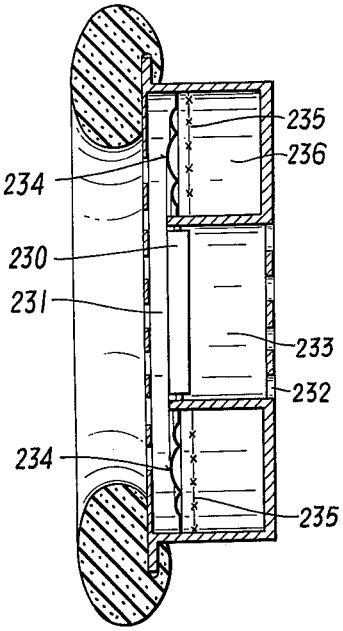

In FIG. 24, still another embodiment is shown, also comprising an electrostatic or piezoelectric transducer.

The transducer 230 operates into a coupling space 231. At its back side, it communicates through a perforated protective wall 232 with the outside air. Instead, wall 232 may also be solid, thus enclosing an air chamber 233, and provided with a mass-loaded sound passage. The transducer is surrounded by passive diaphragms 234. The acoustic frictional resistances 235 for damping may also be comprised in the passive diaphragms. Thus, for example, paper or a diaphragm of plastic with an embedded fabric may be used, which provides the diaphragm with an internal friction. Passive diaphragms 234 adjoin air chambers 236. Provided the chambers 233 and 235 are closed toward the outside air, no sound can pass to the outside or from the outside to the ear. If a very narrow opening is provided in the boundary of chambers 233 and 235 in order to compensate atmospheric pressure variations, the acoustic performance is not affected. The fundamental resonances of passive diaphragms 234 may be identical or different, and so can be the sizes of air chambers 236 and the values of acoustic frictional resistances 235. This makes it possible to obtain the desired frequency characteristics by acoustic adjustment.

The progressive achievement of the invention is to be seen substantially in the fact that a plurality of components which are advantageous for the sound transmission improvement are united. The passive diaphragms permit a tuning of the frequency characteristic of the headphone within large limits. The coupling space is damped so that disturbing standing waves in the range of higher frequencies are suppressed. However, the comb-filter effect of the earpiece is maintained. Due to the elimination of resonances in the coupling space and to the optimum frequency response, the sound signals in the auditory canals (ear signals) are brought close to a live sound reproduction. As it is well known, very small disturbances of these ear signals lead to troubles in the auditory perspective. Frequently, monaural and even stereophonic headphone reproduction results in interaural signal differences effecting a frequency-dependent to-and-fro migration of the direction of the audible event and, thereby, its annoying "in-the-head" or at least close-to-the-head localization.

Further, the invention constitutes a substantial progress in the auditory distance and direction perception with headphones. The numerous parameters such as adjustment of the passive diaphragms, damping of the transducer and passive diaphragms, and adjustment of the frequency response of the transducer, are the prerequisites for adapting the level and phase group velocity conditions of the ear signals to those of the live sounds.

Figure 25:
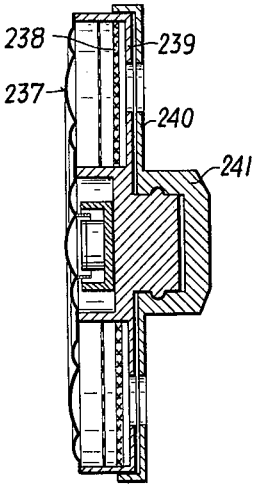
FIG. 25 is a sectional view of an embodiment comprising a variable frictional resistance for the passive diaphragm, which can be varied by means of an adjusting mechanism.

The adjustment may also be made controllable from the outside of the headphone, and FIG. 25 shows such an embodiment.

Figure 26:
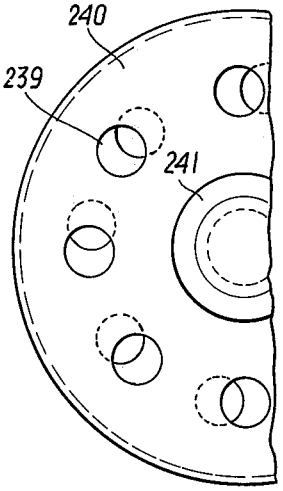
FIG. 26 shows the adjusting mechanism of FIG. 25 in an elevation view.

In FIG. 25, the acoustic frictional resistances 238 associated with the passive diaphragms 237 are made variable. In the present example, the cross-sectional area of the resistance surface is varied by means of an apertured screen 239. As shown in FIG. 26, a disc 240 may be adapted to be turned by means of a knob 241 so that the surface of the resistance becomes more or less covered. Another possibility is to provide an appropriate mechanism for compressing the damping material and thus varying the frictional resistance.

Figure 27:
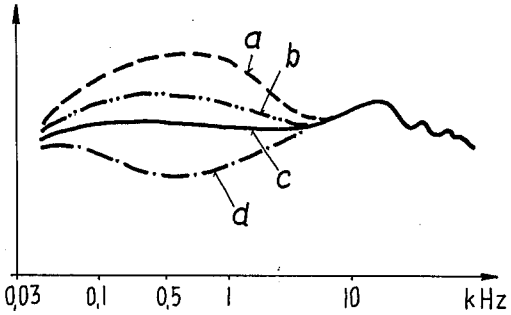
FIG. 27 graphically illustrates the effect of the adjusting mechanism of FIGS. 25 and 26 on the frequency characteristic of the inventive headphone.

FIG. 27 illustrates the influence of the device of FIGS. 25, 26 on the frequency characteristic. With the apertured screen 239 fully covered, i.e., with an infinitely great frictional resistance, curve *a* is obtained. By gradual opening of the apertures, i.e., by turning disc 240, curves *b*, *c* and, finally, with fully opened apertures, the curve *d* are obtained. The optimum for the best sound impression is approximately curve *c*.

Figure 28:
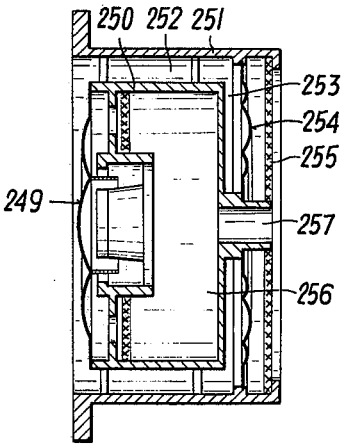
FIGS. 28 and 29 are sectional views of embodiments of a headphone in accordance with the invention, in which a passive diaphragm is located at the outside of or in the zone of the headphone casing.

In FIG. 28, an annular duct 252 is formed around the transducer diaphragm 249, between the transducer case 250 and the outer casing 251, which duct leads to a flat air chamber 253. Chamber 253 is closed by a passive diaphragm arrangement 254 associated with an acoustic frictional resistance 255. Thereby, the coupling space to the ear is connected, through the passive diaphragm arrangement 254, to the outside air. At its back side, transducer diaphragm 249 is separated from the outside air by a cavity 256. If it is desired to connect this cavity also with the outside air, a central opening 257 may be provided.

Figure 29:
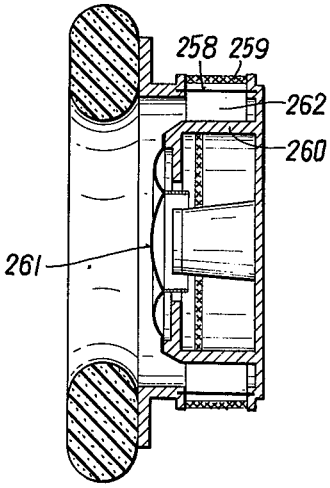

In FIG. 29, a cylindrical passive diaphragm 258 associated with an acoustic frictional resistance 259 is provided surrounding in spaced relation the transducer case 260. The sound signals of the transducer diaphragm 261 pass from the coupling space through an annular duct 262 and the passive diaphragm 258 as well as frictional resistance 259 to the outside. At its back side, the transducer may be vented by openings.

As has already been pointed out, due to a further inventive provision, both the disturbing "in-the-head-localization" during the reception with headphones can be eliminated and a headphone equipped in accordance with the invention makes it possible, while listening to electronic musical instruments, to perceive the vibrato, i.e., a frequency modulation of the produced tone having a small frequency variation, which possibility is not given with conventional headphones.

Figure 30:
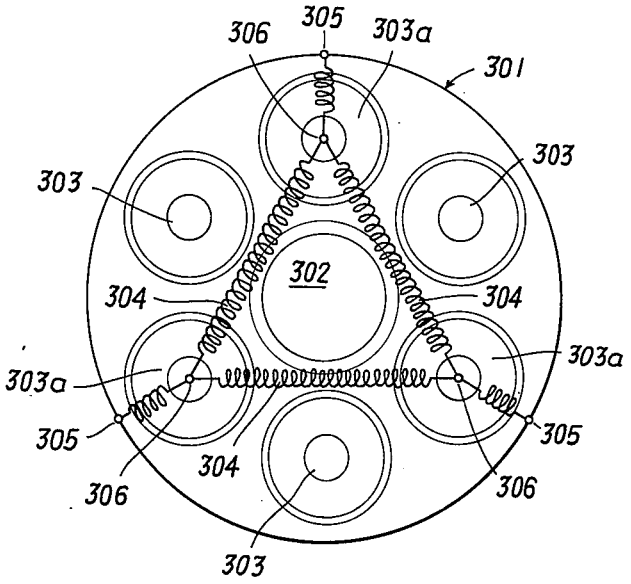
FIGS. 30 and 31 are elevation views of further developments of the invention intended to eliminate the "in-the-head-localization" during reception with headphones.
Figure 31:
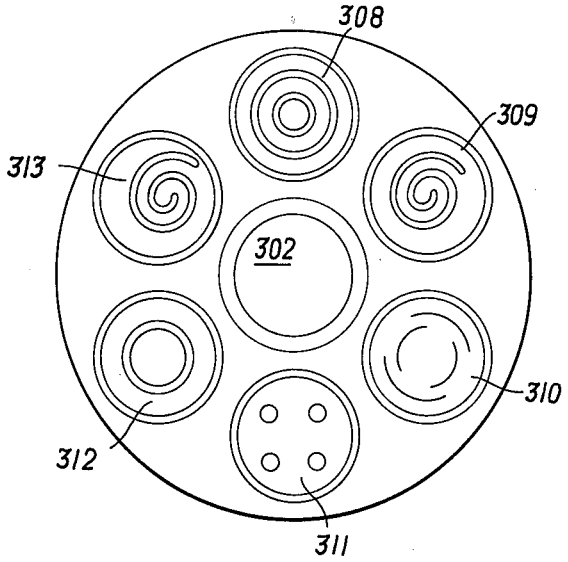

Two embodiments complying with this requirement are diagrammatically represented in FIGS. 30 and 31. In the example of FIG. 30, each headphone system comprises an electro-acoustic transducer, of which only its diaphragm 302 is shown, located in the center of a disc-shape body 301 representing the boundary of the coupling space to the ear. Surrounding the transducer diaphragm 302, six passive diaphragms 303, 303*a* are provided in the sound path extending from the front to the back side of diaphragm 302 of the transducer, which passive diaphragms have mutually different self-resonances, but, at least in the present example, are not designed as an oscillatory structure with a plurality of closely adjacent resonance points. This property is imparted to helical springs 304 which are connected to each other at their ends and are coupled, at these junctions, to the passive diaphragms 303*a*. The system formed by helical springs 304 is attached, at its corner points, to anchor lugs 305 associated with disc 301. The coupling of helical springs 304 to passive diaphragms 303*a* may be effected, for example, so that springs 304 slightly rest on the cupolas 306 of diaphragms 303*a*. Ordinarily, this coupling is satisfactory. However, it may also be made very firm, for example, by applying a small quantity of an adhesive between spring 304 and the diaphragm cupola. Other methods of coupling, of course, are also possible, for example, an elastic coupling, provided such a provision should prove useful in special cases.

Depending on the dimensioning of helical springs 304 or their number, a more or less distinctive sound impression is obtained having a character which, in practice, due to the use of helical springs with statistically distributed superficial disturbance areas produced by etching and/or sandblasting or by notches or knees in the spring, corresponds to the real spatial sound effect. This effect of the inventive arrangement is based on the fact that, because of the closely adjacent resonance points of helical springs 304, the passive diaphragms 303*a* become effective accordingly, so that the acoustic short through a passive diaphragm 303*a* is subjected to statistically distributed irregularities.

In the same manner, in principle, the same effect is obtained in the embodiment shown in FIG. 31. It differs from the embodiment of FIG. 30 in that each of the passive diaphragms 308 to 313 itself is designed as an oscillatory structure having numberous, closely adjacent, resonance points. The construction is substantially identical with the embodiment of FIG. 30, but without the helical springs. The function of the helical springs is transferred to the particularly designed passive diaphragms 308 to 313. In order to obtain the required unequal distribution of masses and elasticity, the passive diaphragms, in this example, are provided with mutually different embossed areas or areas with additionally applied matter. The areas may be of any configuration. Thus, for example, they may have the form of concentric rings, spirals, uniformly or irregularly distributed mass points, linear or arcuate elements, etc.

Even though the idea underlying the invention is basically simple, the variety of embodiments, in no way including all of the possibilities, shows that a means is thereby given to the competent designer to provide for the manufacture of headphones of the highest quality which cannot be achieved, as to the frequency response and plastic sound fidelity, by any of the conventional headphones.

While specific embodiments of the invention have been shown and described in detail, to illustrate the application of the principles of the invention, it will be understood that the invention may be embodied otherwise without departing from such principles.

What is claimed is:

1. In a headphone of the type comprising a toroidal seal ring which, in the operational position of the headphone, rests against or surrounds the user's ear, is constituted by a soft, yielding, and elastic material, and, with the headphone positioned on the head of the user, forms a coupling space between an active diaphragm, actuated by an electroacoustic transducer, and the auditory canal of the user's ear, and which coupling space is substantially sealed from the exterior of the headphone, the improvement comprising, in combination, said coupling space being formed with at least one opening; a respective passive oscillatory diaphragm, having a definite self-resonance, mounted in each opening and associated with a sound path leading therefrom and providing, with the associated passive diaphragm, an optimum frequency characteristic.

2. An improved headphone, as claimed in claim 1, in which each sound path leads to the open air.

3. An improved headphone, as claimed in claim 1, in which each sound path leads to the back side of the active transducer diaphragm.

4. An improved headphone, as claimed in claim 1, in which said coupling space is formed with a plurality of openings circularly surrounding said transducer diaphragm.

5. An improved headphone, as claimed in claim 1, in which each sound path leads to a cavity having an acoustic effect within the transmission range of the transducer.

6. An improved diaphragm, as claimed in claim 5, in which at least some of said passive diaphragms have their masses and elasticities distributed unequally.

7. An improved headphone, as claimed in claim 6, in which at least some of said passive diaphragms are formed with embossed areas.

8. An improved headphone, as claimed in claim 6, in which at least some of said passive diaphragms have areas with additional matter applied thereto.

9. An improved headphone, as claimed in claim 1, including respective acoustic frictional resistances associated with each passive diaphragm.

10. An improved headphone, as claimed in claim 9, in which each acoustic frictional resistance is located so close to the associated passive diaphragm that, due to the mass of the passive diaphragm and the restoring force of the secondary air pressure space formed between the frictional resistance and the associated passive diaphragm, a resonant point is produced in the high-frequency range.

11. An improved diaphragm, as claimed in claim 10, in which said passive diaphragms have respective different self-resononces.

12. An improved headphone, as claimed in claim 9, including a respective adjusting member, located outside a casing of the headphone, operatively associated with each acoustic frictional resistance to vary the magnitude thereof.

13. An improved headphone, as claimed in claim 12, in which said adjusting member comprises a disc rotatable from the exterior of the headphone and having corresponding apertures associated with said openings in said coupling space; said disc being angularly adjustable to adjust the effect of the frictional resistances to any value.

14. An improved headphone, as claimed in claim 12, including a resistance, actuable from the exterior of the headphone, operable to adjust the density, and thus the resistance value, of each acoustic resistance.

15. An improved headphone, as claimed in claim 1, in which said coupling space is formed with an annular opening surrounding said active transducer diaphragm and a substantially plane, annular, passive diaphragm mounted in said annular opening.

16. An improved headphone, as claimed in claim 15, in which said annular passive diaphragm is provided with embossed areas.

17. An improved headphone, as claimed in claim 15, in which the inner periphery of the annular passive diaphragm and the outer periphery of the active transducer diaphragm are united to each other at a junction zone which is engaged with a toroidal body; a surface elevation of the conjoint diaphragm limiting said coupling space.

18. An improved headphone, as claimed in claim 17, in which said active transducer diaphragm and said passive diaphragm form a diaphragm system comprised in a single structural part.

19. An improved headphone, as claimed in claim 17, in which said toroidal body is secured to a support connected to the electroacoustic transducer.

20. An improved headphone, as claimed in claim 17, in which said toroidal body is provided on a surface limiting said coupling space.

21. An improved headphone, as claimed in claim 15, in which the inner periphery of the annular passive diaphragm and the outer periphery of the active transducer diaphragm are united to each other at a junction zone which is engaged with a surface limiting said coupling space.

22. An improved headphone, as claimed in claim 21, in which said surface is formed of a hard material.

23. An improved headphone, as claimed in claim 21, in which said surface is formed of a sound absorbing material.

24. An improved headphone, as claimed in claim 21, in which said surface is formed by a torus.

25. An improved headphone, as claimed in claim 21, in which said surface is on an intermediate part inserted in said headphone.

26. An improved headphone, as claimed in claim 1, including a housing mounting two active diaphragms each actuated by a respective electroacoustic transducer, for the quadrophonic reproduction of audible events; said coupling space being common to both transducer diaphragms; said coupling space being formed with respective openings associated with each active transducer diaphragm; each opening receiving a respective passive diaphragm.

27. An improved headphone, as claimed in claim 26, in which said common coupling space is further formed with openings between said two active transducer diaphragms, and each of said further openings having a respective passive diaphragm mounted therein.

28. An improved headphone, as claimed in claim 26, in which each active transducer diaphragm is surrounded by an annular opening of said common coupling space; each annular opening receiving an annular passive diaphragm.

29. An improved headphone, as claimed in claim 1, in which said coupling space is divided into two compartments communicating with each other through an acoustic conduit; said openings receiving said passive diaphragms being formed in that coupling space compartment which, with the headphone mounted on the head of a user, engages or surrounds the ear.

30. An improved headphone, as claimed in claim 29, in which the coupling space compartment immediately adjacent the active transducer diaphragm is formed with the openings receiving the passive diaphragms.

31. An improved headphone, as claimed in claim 29, in which the openings receiving the passive diaphragms are located in a circular arrangement around the entrance of the acoustic conduit extending into the coupling space compartment which, during use of the headphone, is adjacent the ear of the user.

32. An improved headphone, as claimed in claim 29, in which the self-resonances of the passive diaphragms are partly responsive to identical frequency ranges and partly tuned to the pipe resonances of the acoustic conduit connecting the two compartments of the coupling space.

33. An improved headphone, as claimed in claim 29, in which the self-resonances of the passive diaphragms are partly responsive to different frequency ranges and partly tuned to the pipe resonances of the acoustic conduit connecting the two compartments of the coupling space.

34. An improved headphone, as claimed in claim 29, in which the self-resonances of the passive diaphragms are partly responsive to selected peaks in the frequency characteristic of the transducer.

35. An improved headphone, as claimed in claim 1, including a respective acoustic frictional resistance operatively associated with each passive diaphragm; at least one of said openings in said coupling space leading to a cavity provided with an opening leading into the open air and having a negligible acoustic resistance; the back side of said active transducer diaphragm communicating with an acoustic cavity provided with an opening leading to the open air and having a high acoustic frictional resistance.

36. An improved headphone, as claimed in claim 35, in which said openings in said coupling space lead into a cavity having an acoustic effect within the transmission range of the transducer.

37. An improved headphone, as claimed in claim 1, including a respective acoustic frictional resistance operatively associated with each passive diaphragm; at least one of said openings in said coupling space leading to a cavity provided with an opening leading into the open air and having a negligible acoustic resistance; the back side of the active diaphragm communicating with an acoustic cavity which is completely closed relative to the exterior of the headphone.

38. An improved headphone, as claimed in claim 37, in which said openings in said coupling space lead into a cavity having an acoustic effect within the transmission range of the transducer.

39. An improved headphone, as claimed in claim 1, in which said electroacoustic transducer has the backside of its diaphragm communicating with a respective cavity; each passive diaphragm having associated therewith a respective acoustic frictional resistance; said passive diaphragms being located in openings of cavities leading directly to the exterior of said headphone.

40. An improved headphone, as claimed in claim 39, in which said headphone includes an at least partly cylindrical headphone casing in the form of a shell; said passive diaphragms being joined to form a single passive diaphragm having the form of a short cylindrical tube and located in the zone of said shell.

41. An improved headphone, as claimed in claim 1, in which said coupling space is formed with a plurality of openings each receiving a respective passive diaphragm; said passive diaphragms being connected to at least one oscillatory structure comprising a plurality of closely adjacent resonance points.

42. An improved headphone, as claimed in claim 34, in which said oscillatory structure comprises a helical spring having a surface provided with irregularities which are statistically distributed in the macroscopic and microscopic range.

43. An improved headphone, as claimed in claim 41, in which said passive diaphragms are arranged concentrically about said active transducer diaphragm, there being an even number of passive diaphragms; and a helical spring coupling at least two of said passive diaphragms to each other.

44. An improved headphone, as claimed in claim 1, in which said coupling space is formed with a plurality of openings each receiving a respective passive diaphragm; said passive diaphragms being structured to form a plurality of closely adjacent resonance points.

* * * * *